United States Patent [19]

Saito et al.

[11] Patent Number: 4,653,891

[45] Date of Patent: Mar. 31, 1987

[54] PHOTOSENSITIVE MATERIAL PROCESSING APPARATUS

[75] Inventors: Kaneo Saito, Hino; Fujio Kodaka, Kasukabe; Kazuyoshi Tsurumaki, Shiraoka, all of Japan

[73] Assignee: Konishiroku Photo Industry Co., Ltd., Tokyo, Japan

[21] Appl. No.: 700,783

[22] Filed: Feb. 12, 1985

[30] Foreign Application Priority Data

Feb. 18, 1984 [JP] Japan ..... 59-29240

[51] Int. Cl.[4] ..... G03D 5/02

[52] U.S. Cl. ..... 354/304; 354/314; 354/318

[58] Field of Search ..... 354/303, 304, 318, 313, 354/314

[56] References Cited

U.S. PATENT DOCUMENTS

| | | | |
|---|---|---|---|
| 4,214,830 | 7/1980 | Schroder | 354/288 |
| 4,309,100 | 1/1982 | Bendoni et al. | 354/318 |
| 4,370,045 | 1/1983 | Holmes | 354/318 |
| 4,371,248 | 2/1983 | Sulesky | 354/318 |
| 4,371,249 | 2/1983 | Czumak | 354/318 |
| 4,537,485 | 8/1985 | Saito | 354/304 |

*Primary Examiner*—A. A. Mathews

*Attorney, Agent, or Firm*—Jordan B. Bierman

[57] ABSTRACT

An automatic processing apparatus has mounts for exposed photosensitive material and a web. A take-up spool take up the exposed photosensitive material and the web so that they are placed in the contact with each other. A housing contains the mounts, the take-up spool, and a drive for the take-up spool. A lid pivots about a joint member connected to the housing to keep the housing light-proof when the lid is closed. A device for depressing a processing chemicals container interlocks with the lid. A coating device between the mount for the web and the take-up spool coats the processing chemicals on the web. A switching member detects the closing of the lid and commences the take-up operation for the exposed photosensitive material and web.

8 Claims, 7 Drawing Figures

PHOTOSENSITIVE MATERIAL PROCESSING APPARATUS

BACKGROUND OF THE INVENTION

1. Field of the Invention

This invention relates to a photosensitive material processing apparatus including, for example, an automatic developing apparatus, in which a development or the like can be performed in a short time by bringing processing chemicals into contact with such a photosensitive material as a roll-film or photoprinting paper; and, more particularly, to an automatic processing apparatus for processing instant type photosensitive materials.

2. Description of the Prior Art

U.S. Pat. No. 4,309,100 and other prior art disclose developing apparatuses for processing an instant type photosensitive material, which are relatively compact in size, inexpensive in cost and simple in operation. Whereby, however, a stable photographic image is not always obtainable, because the processing liquid and photosensitive material thereof should separately be provided, so that the apparatuses are too delicate to handle. U.S. Pat. Nos. 4,370,045, 4,371,248 and 4,371,249 disclose, respectively, developing apparatuses incorporating therein a photosensitive material and processing chemicals and taking up the photosensitive material and a sheet material coated with the processing chemicals. Whereby, a stable photographic image is not always obtainable too, because after setting a processing liquid and an exposed photosensitive material in the apparatus, the sheet material and photosensitive material superposed are rewound by hand so that the rewinding time may not be kept constant, and also because such rewinding is carried out by operating a lever for switching over to rewinding mode. To solve the above-mentioned problems, Kaneo Saito, one of the inventors of this invention, proposed an "Automatic Developing Machine" in the Application Ser. No. 543,823 filed on Oct. 20, 1983, now U.S. Pat. No. 4,537,485, wherein a photosensitive material and a guide web, that is a sheet material, are superposed on take-up spool and they are held in place so as to be taken up or rewound by an electric motor, and the take-up operation is then stopped upon automatically detecting a moment when completing the taking-up operation.

The inventors of this invention have improved the above-mentioned Saito's invention. According to this invention, an automatic developing apparatus can be achieved, in which the adhesive property of a material coated with processing chemicals to a photosensitive material can be improved and both of the materials can be taken up and then rewound after a certain time lag, with relatively more accuracy; and in rewinding, any manual operation such as a push-button operation is not required but an automatic rewind is commenced so as to always perform every stable development; and, in addition, any stains caused by processing chemicals remaining on the surface of the material coated with the processing materials can completely be prevented.

SUMMARY OF THE INVENTION

It is an object of the invention to provide a photosensitive material processing apparatus capable of performing such an automatic development as is able to obtain uniform images without any unevenness from a long photosensitive material.

Another object of the invention is to provide a photosensitive material processing apparatus in which a rewind of an exposed photosensitive material and a material coated with processing chemicals can automatically be performed so that every developing time can be kept constant.

A further object of the invention is to provide an automatic developing apparatus in which, after developing an exposed photosensitive material, no stain is caused by processing chemicals.

CONSTITUENTS OF THE INVENTION

Figure 1:
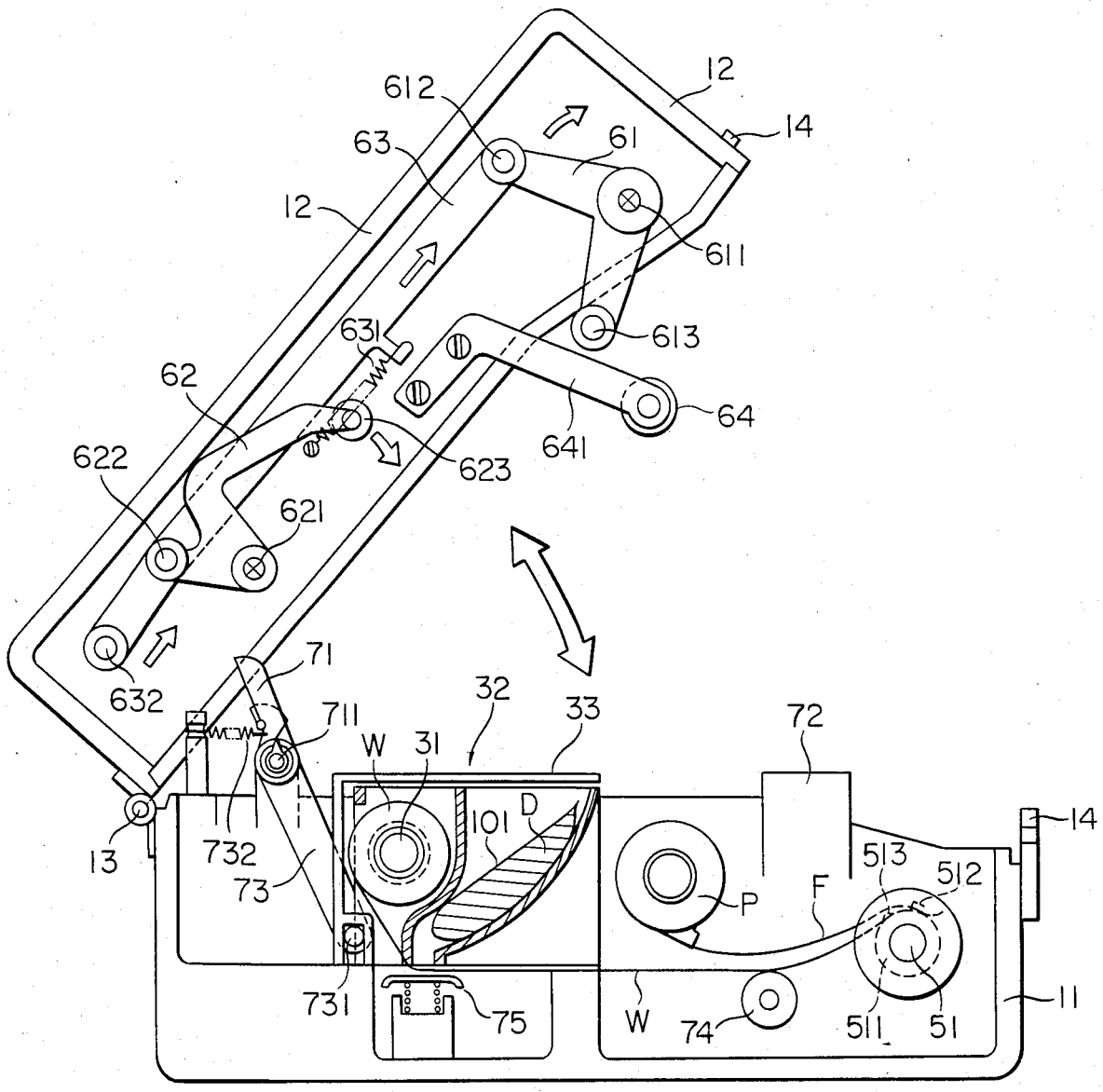
FIG. 1 is a cross-section of a photosensitive material processing apparatus with the lid thereof opened.

To achieve the objects of the invention, an automatic developing apparatus thereof is so constituted as to comprise,

- a fixing means for mounting an exposed photosensitive material and a material coated with processing chemicals;
- a take-up spool for taking up the exposed photosensitive material and material coated with the processing chemicals superposed together;
- a main housing containing a motor for driving the take-up spool;
- a lid capable of opening and closing, fitted to the main housing through a joint so that a light-proof condition can be provided thereby together with the main housing; and
- a switching means for electrifying a control circuit, with the purpose of automatically commencing the taking-up operation at the time when the lid is closed.

To be more concrete, in an automatic developing apparatus so constituted as to take up both of a material (e.g., a tape) coated with processing chemicals such as a developer for processing photosensitive materials and an exposed photosensitive material (e.g., a long roll-film) superposed, with bringing the processing chemical coated surface of the tape, for example, into contact with the photosensitive material, and after a certain time lag, both of them are rewound to their original positions and thereby the photosensitive material (e.g. a photosensitive film) can be developed with the processing chemicals; there constitutes to provide a control means for controlling the start, stop and back and forth driving of a means (e.g., a motor) for driving the material coated with processing chemicals and the photosensitive material; and the control means comprises an operation starting circuit sending a signal for actuating the driving means so as to take up the material coated with processing chemicals and photosensitive material superposed together; a timer circuit for actuating the driving means so as to correspond to a point of time when the processing chemicals are coated on the material to be coated therewith; a take-up completion detecting circuit from which a signal is sent to stop the driving means when completing the taking-up and, at the same time, to reverse a driving direction of the driving means; a rewind circuit from which a rewind starting signal is sent upon receipt of a signal from the taking-up completion detecting circuit so as to reverse the driving direction of the driving means that has been in a taking-up mode; and a rewind completion detecting circuit for commanding the driving means to stop in operation when completing the rewind.

Other objects and advantages of this invention will readily become apparent in the detailed description of the following example.

EXAMPLE

This invention will now be described with reference to the following example taken in connection with the accompanying drawings wherein, 11 is a main housing, 12 is a lid made of a light-proof material. It opens and closes the main housing 11 swingingly about hinge 13 and is kept closed by latch 14. Main housing 11 and lid 12 are swingably dovetailed or scarf-jointed with grooves, etc., so that the inside thereof becomes a dark chamber in which developments are carried out when the lid is closed.

In order to carry out a development, it is required to load an apparatus being opened as shown in FIG. 1 with a photosensitive material and a processing chemical kit comprising a material W coated with processing chemicals and a procesing chemical container containing processing chemicals (e.g., a developer).

Photosensitive material comprises an exposed roll-film F. It is loaded in a cartridge P and the leading end of the roll-film F remains outside of the cartridge P. Such a photosensitive material may also be allowed to be a rolled photoprinting paper. The cartridge P is so fitted as to couple to shaft 21 provided to main housing 11.

Jellylike developer D is sealed up in a flexible container 101 having a portion rupturable when depressing.

Material W coated with processing chemicals is a web-shaped one a little longer than the roll-film F, and is wound round a shaft 31 so as to be stored, together with developer D as a unit, into a case 32 which is provided with a cover 33 capable of opening and closing with sliding right and left.

The leading ends of material W coated with processing chemicals and roll-film F are pulled out to fit to the hook of take-up spool 511 provided to main housing 11. In this example, there are a hook 512 and another hook 513 around take-up spool 511 and the leading end of material W coated with processing material is attached to hook 513 and roll-film F to hook 512, respectively.

Figure 3:
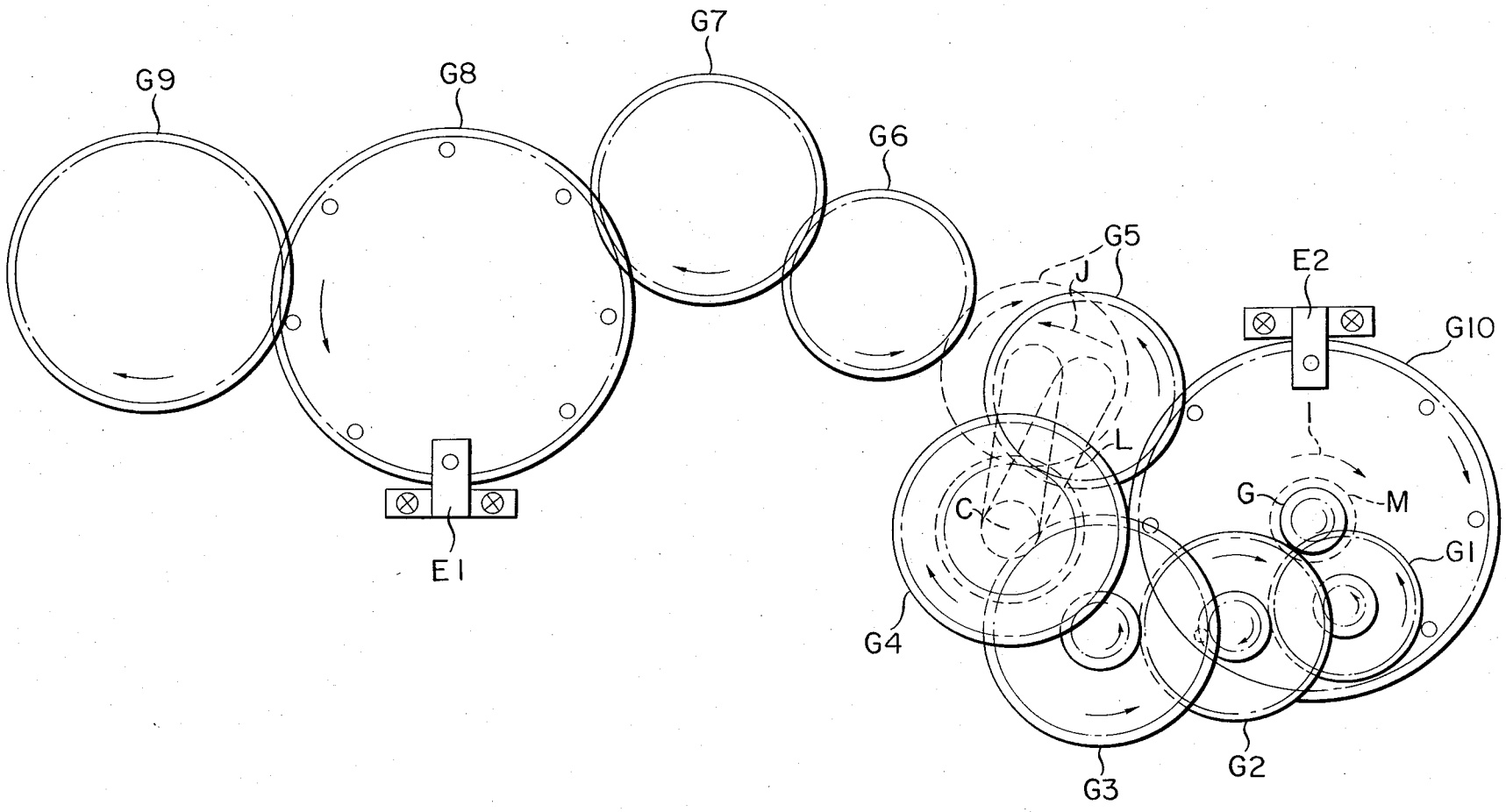
FIG. 3 is a schematic illustration of the substantial portions of the driving mechanism of the apparatus shown in FIGS. 1 and 2.

As illustrated in FIG. 3, when motor M is rotated in the direction of the broken line I, gear G5 is engaged with gear G10 by gear G fitted to the shaft of motor M passed through gear 10 and a group of gears 1, 2, 3, 4 and 5 transmitting the rotating force of motor M, so that gear G10 is rotated in the direction of the arrow shown in FIG. 3. Gear G10 is fitted with take-up spool 511 for taking up material W coated with processing material and roll-film F. In FIG. 3, the directions of rotating the gears are those in the case that take-up spool 511 is taking up the material W coated with processing chemicals and the roll-film F. Now, referring to the case of rewinding material W and roll-film F, when rewinding material W, motor M will rotate oppositely to the direction of broken lined arrow I, and gears Gl through G5 will also rotates oppositely to the rotation indicated in FIG. 3. When gear G4 rotates in the opposite direction, lever L fitted to the fixed shaft of gear G4 is rotated about the center C of gear G4 in the direction of broken lined arrow J by the rotating force of gear G4, gear G5 having been transmitting its rotating force to gear G10 when having been taking up will transmit the rotating force to gear G6 instead when rewinding. Accordingly, the rotating force of motor M will not be transmitted to take-up spool 511 fitted to gear 10 so as to become free. When transmitting the rotating force of gear G5 to gear G6, each of gears G6 through G9 is rotated in the direction of the arrow shown in FIG. 3. Gear G7 is provided with shaft 21 capable of coupling to cartridge P wound up thereround with roll-film F, and gear G9 is provided with shaft 31 wound up thereround with material W. Therefore, the material W and the roll-film F are to be rewound about shaft 31 and cartridge P, respectively. The numbers of rotation of shaft 511, cartridge P and shaft 31 each are detected by encoders El and E2 arranged respectively to the outer circumferences of gear G8 and gear G10 so as to regulate the numbers of rotation. In FIG. 3, two pieces of encoders are provided, however, it is also allowed to provide either one of them.

Inside cover lid 12, there are provided with levers 61 and 62 having respectively shafts 611 and 621 which are directly fitted to lid 12. Lever 63 is formed in a link with shafts 612 and 622, and it is pulled in the left by spring 631 hooked one end thereof at lever 63. One end of lever 63 is fitted with roller 632 which can touch with lever 71 provided to the main housing, when closing the lid.

Roller 613 is so provided to one end of lever 61 as to fit into joint 72 provided to main housing, when opening the lid. To one end of lever 62 is provided with roller 623 for depressing container 101 containing the aforementioned developer D. These levers 62 and 63 are able to depress container 101 when opening and closing the lid, even if they are arranged to either lid 12 or the side of chamber 32.

Lever 641 is provided to the inside of lid 12 and the end of lever 641 is formed in roller 64. This roller 64 touches roller 74 provided to main housing 11 when closing the lid, and material W and roll-film F are held by and between these two rollers 64 and 74.

Two levers 71 and 73 provided to the main housing are capable of rotating coaxially about shaft 711. Lever 73 is energized counterclockwise by spring 712, and both levers 71 and 73 are so energized by spring 712 as to be superposed on mutually. To one end of lever 73 is provided with protrusion 731 which will couple to cover 33 of chamber 32 when the chamber 32 is loaded in while the lid 12 is opened.

Figure 2:
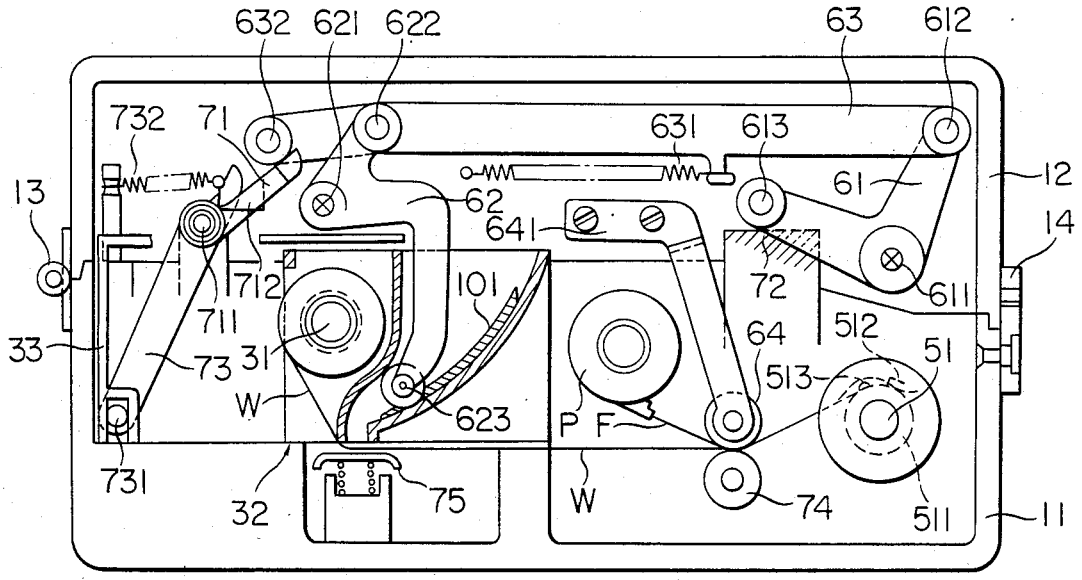
FIG. 2 is a cross-section of the apparatus shown in FIG. 1, with the lid thereof closed.

While the lid is kept open as shown in FIG. 1, cartridge P and chamber 32 are loaded into main housing 11 and both of the leading ends of material W and roll-film F are fitted to hooks 513, 512 at take-up spool 511 and then lid 12 is closed. At that time, the state of things are changed to that shown in FIG. 2. To be concrete, roller 613 provided to lid 12 is rolled over joint 72 when putting them together, and lever 61 will rotate clockwise. Lever 63 linked to lever 61 and shaft 612 will move to the right, and roller 632 will get in touch with lever 71, thereby lever 73 will rotate clockwise through the operation of springs 712 and 713, and then cover 33 of chamber 32 is moved to the left so as to be opened, by protrusion 731.

As lever 63 is being moved to the right, lever 62 will rotate clockwise so as to make roller 623 depress container 101 containing developer D. Thereby, the rupturable portion of container 101 is broken to press down developer D sealed up in the container 101, so that the developer D may adhere onto material W positioned on pressure plate 75 provided to main housing 11. When closing lid 12, roller 64 provided to the inside of the lid 12 will descend to depress roller 74 with the interposition of roll-film F and material W coated with developer D.

Switch SW2 of a power circuit is switched over to ON-state by closing lid 12 to send to take-up starting signal, so that a taking up operation can be commenced after a certain time lag. The reason why a certain time lag from the closing of the lid 12 up to the starting of the taking-up is required is that such a taking-up can be started and the development can then be carried out after developer D is squeezed out from container 101 so as to sufficiently adhere to material W. When a certain length of roll-film F is taken up around take-up spool 511, the take-up spool 511 is stopped in rotation to bring roll-film F into close contact with material W, so that the development thereof can be performed.

Figure 4:
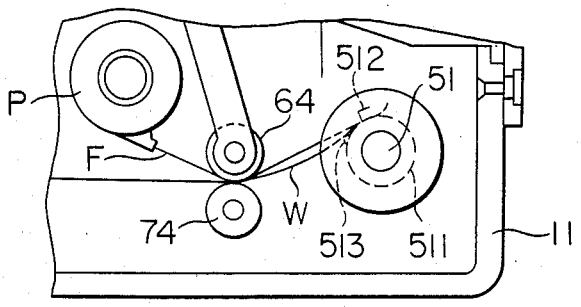
FIG. 4 illustrates a material coated with processing chemicals, which is about to disengage from a hook immediately before a rewind is completed.
Figure 5:
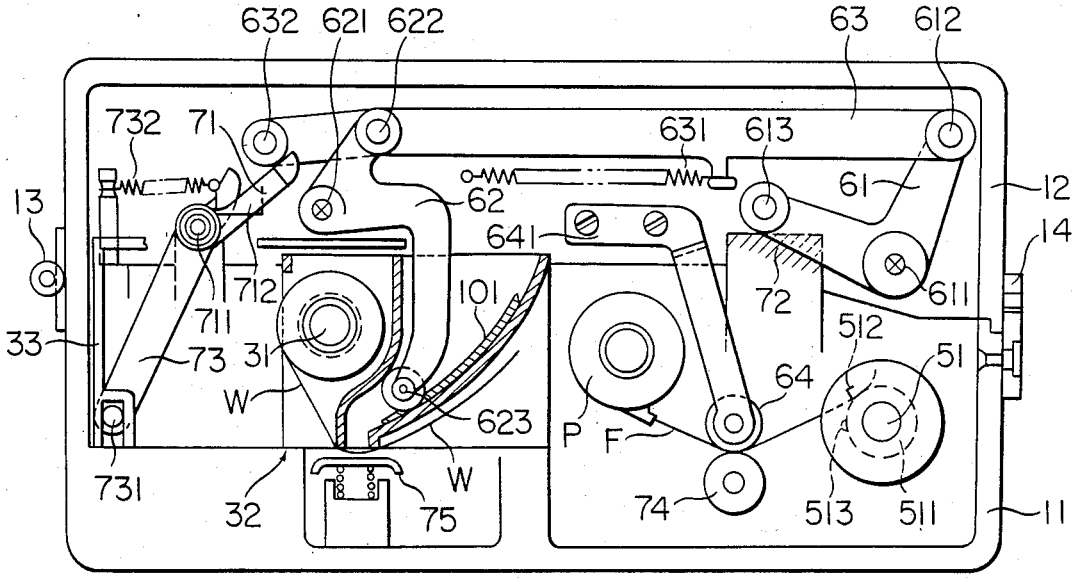
FIG. 5 illustrates a position of the leading edge of a material coated with processing chemicals when completing a rewind.

Now, the description will be made on a step where roll-film F and material W are rewound after the development thereof was completed. As described above, roll-film F is fitted to hook 512 and material W is fitted to hook 513. FIG. 4 is an illustration showing a state where roll-film F and material W are immidiately before completing the rewind thereof. Hook 512 holding roll-film F cannot be detached without doing by hand, because the tip of the hook is bent. On the other hand, hook 513 can naturally be detached from material W when material W is taken up to a position shown in FIG. 4, because hook 513 fitted with material W is in the form of a simple protrusion. As shown in FIG. 5, the material W removed from hook 513 is rewound further to complete the rewind. However, the rewinding operation of the material W is automatically controlled, so that the material W may be kept in a state that it is separated from roll-film F and may also be stopped to keep in a state that all the material W including the leading end is not completely rewound up. To be more concrete, as shown in FIG. 5, the material W is passed through a pair of rollers 64 and 74 and is then stopped in a position before a position of processing chemicals adhering to material W, (i.e., an opening below container 101). Then, roll-film F is taken out by hand from hook 512 after lid 12 is opened.

There is such a danger that a strong alkaline developer D may adhere to hand when taking out roll-film F because the roll-film F is superposed on material W. The above-mentioned constitution has been devised to prevent the danger from occurring.

Now, a description will be made on a drive-control circuit with which material W and an exposed roll-film F are taken up and the aforementioned motor M is used to serve as a driving means for rewinding.

Figure 6:
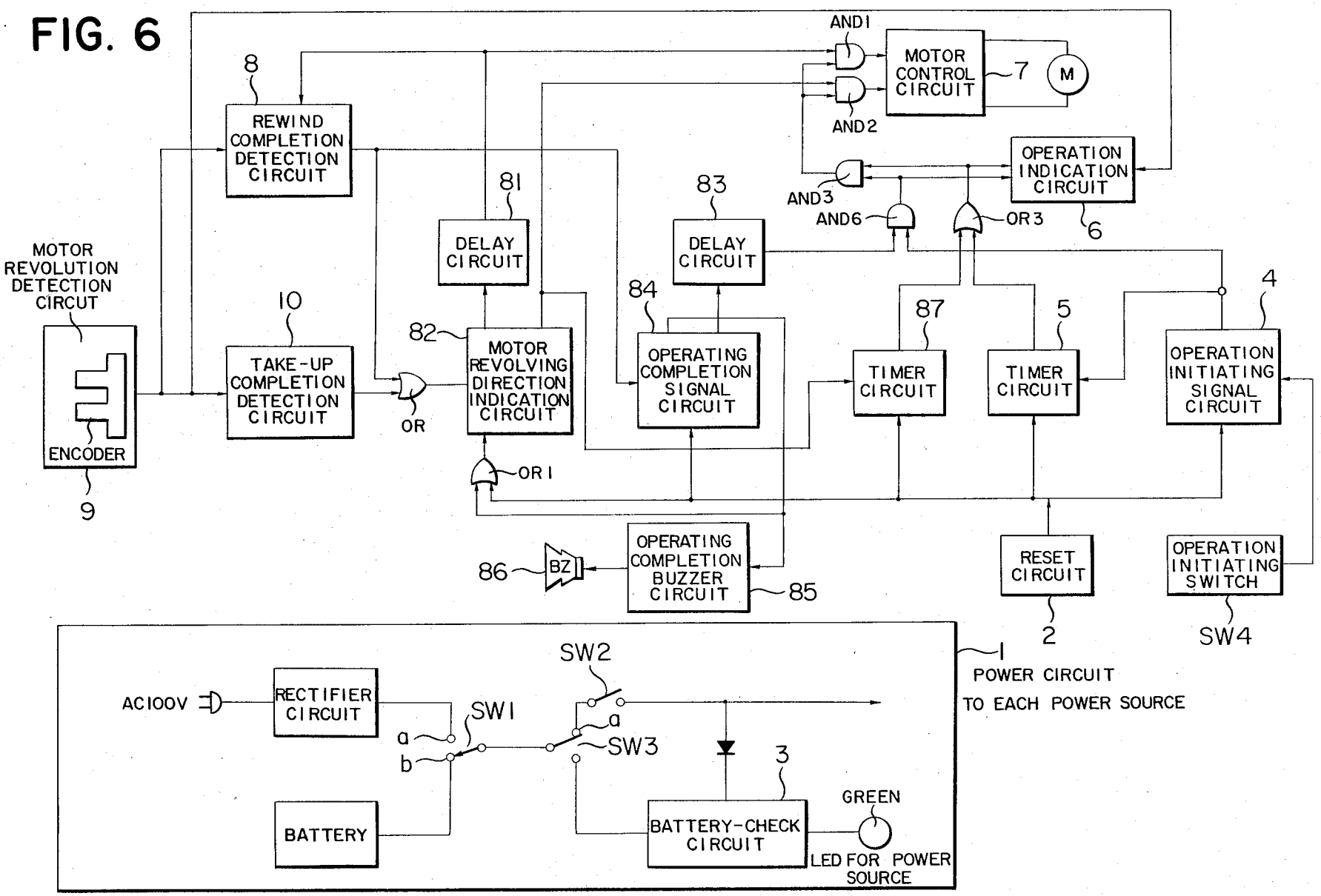
FIG. 6 is a block-diagram of an electric circuit for a drive-control.

FIG. 6 is a block-diagram schematically illustrating the above-mentioned circuit.

Firstly, referring to power circuit 1, in this example, the power source for driving motor M is so arranged as to receive from either one of a domestic plug socket or a battery B. When switch SWl is connected to terminal a, a d.c. voltage rectified from an a.c. 100V of domestic plug socket is applied to output switch SW3, or when SWl is switched over to terminal b, a voltage generated from battery B is applied thereto. Switch SW2 is made in ON-state by closing the aforementioned lid 12, and a power voltage is applied to each circuit of the control circuit system by switching SW3 over to, for example, terminal a.

Battery-checking circuit 3 incorporated in power-circuit 1 is for checking and indicating the voltage of the battery when battery B is used for the power-source.

When switch SW3 is connected to terminal a, resetting circuit 2 is actuated to apply the respective initial resets to a bistable multivibrator (hereinafter called FF) and a monostable multivibrator (hereinafter called MM) each being used for the control circuits, and a Q-output of each of FF and MM is denoted by "L", and a $\overline{Q}$-output thereof is denoted by "H". Motor M is now ready for driving.

When switching on an operation starting switch SW4 for driving Motor M, a signal is given from operation starting signal circuit 4 to timer circuit 5, and a driving signal is then given from timer circuit 5 to motor control circuit 6 with a time lag $t_4$ after the timer circuit 5 received the signal. Upon receipt of the driving signal, Motor M is commenced to rotate thereby, so that shaft 511 is so rotated as to start a taking-up of roll-film F or the like. When the roll-film F and material W coated with processing chemicals are taken up, take-up completion detecting circuit 10 will detects the completion thereof according to the output of motor rotation detecting circuit 9 to stop the driving of Motor M and, at the same time, to send a signal to motor rotation direction commanding circuit 82 from which a signal is given to motor control circit 7 so as to rotate Motor M in the opposite direction to the direction of taking up when this signal is fed in the circuit 82, and a signal is also given to motor control circuit 7 so as to stop the rotation of Motor M with a certain time lag $t_3$. After a certain time lag $t_4$ is passed away, motor M is rotated in reverse, and roll-film F and material W coated with processing chemicals are commenced to rewind. When the rewind is completed, the completion of the rewind is detected by rewind completion detecting circuit 8 according to the output of motor rotation detecting circuit 9, and a signal is given therefrom to motor control circuit 7 to stop the rotation of motor M. This signal is sent with a time lag $t_2$ after the output of motor rotation detecting circuit is given. This time lag $t_2$ is a time required for disengaging material W coated with processing chemicals from hook 513 and the material W is then separated from roll-film F. After passing away time $t_2$, operation completion signal circuit 84 will actuate to reset motor rotation direction commanding circuit 82 into the initial state and will also give a completion signal to operation completion buzzing circuit 85 so as to operate buzzer 86. Next, motor M is put on the brakes only for a time $t_5$ through a delayed action circuit 81 connected to operation completion signal circuit 84, and thereby the leading end of material W coated with processing chemicals is stopped outside chamber 32 (to the position of the material W shown in FIG. 5), so that developer D can be prevented from leaking from the bottom of chamber 32 to the main housing by covering the bottom of chamber 32 with material W.

The motor stopping signal given from motor control circuit 7 is delayed in sending by delayed action circuit 83, with a time lag $t_6$ from the point of time when operation completion signal circuit 84 is actuated. On the other hand, when time lag $t_6$ delayed by delayed action circuit 83 is made longer than time lag $t_5$ delayed by another delayed action circuit 81, motor M is rotated a little in the taking-up direction only for a time of $t_6-t_5$, so that it can become easier to disengage roll-film F from hook 512 by hand.

Now, the description will be made on a concrete electric-circuit, with reference to FIG. 7, in which the aforementioned motor M is served as a driving means for taking up and rewinding both of material W coated with processing chemicals and roll-film F.

Figure 7:
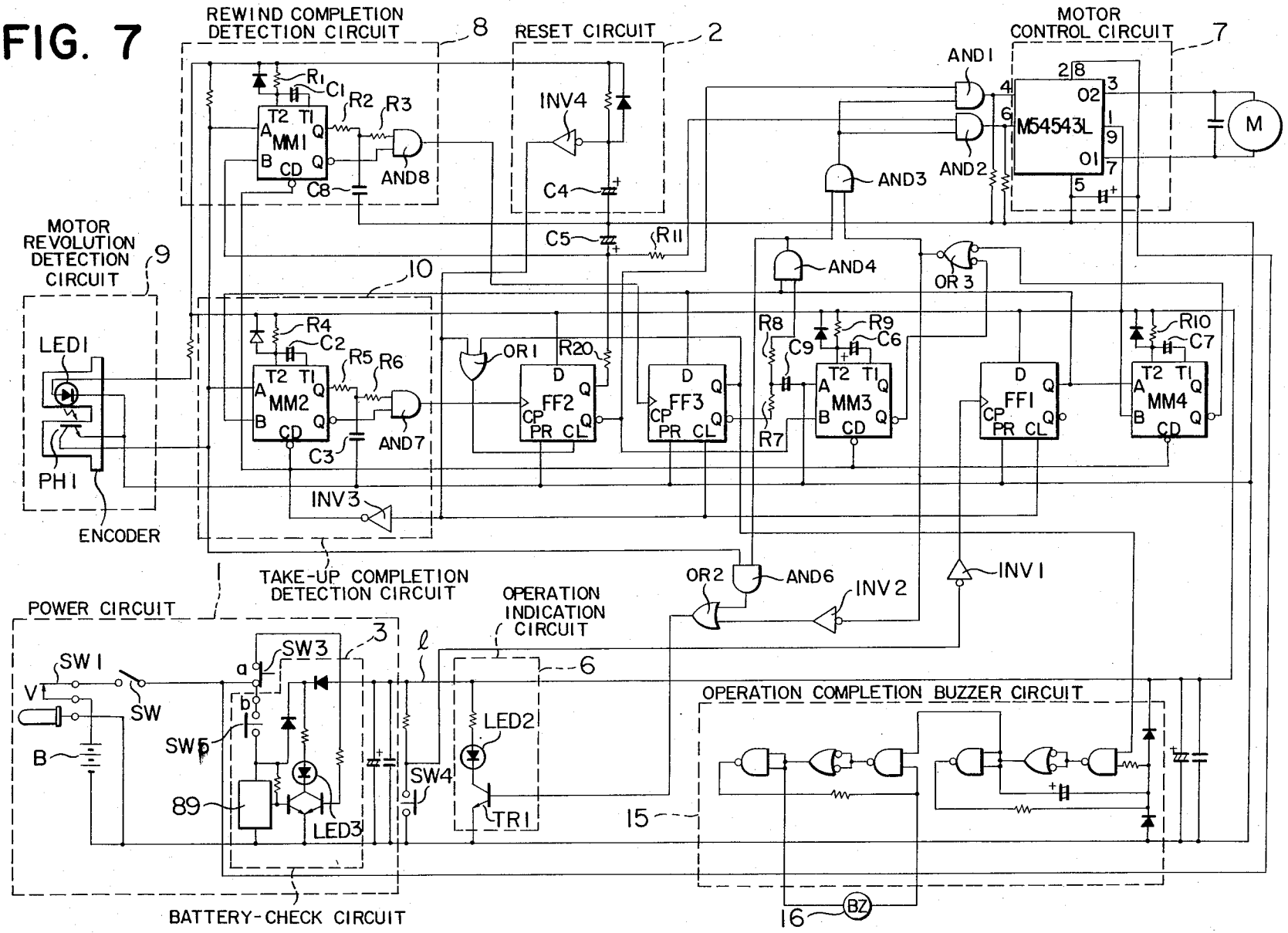
FIG. 7 is an example of the electric circuit diagram shown in FIG. 6.

FIG. 7 illustrates an example of concrete electric-circuits forming the circuit shown in FIG. 6.

Now, in power source circuit 1, switch SW1 is to receive a power supply from an external power source, which makes internal battery B OFF when a jack is plugged in. When switch SW is ON, a voltage is applied from the power source to one of the terminals of switch SW3 and power source circuit is then ready to operate. 89 provided to the inside of battery checking circuit 3 is a constant-voltage power source comprising a zener diode, a comparator and the like, and is to put a light to light emission diode LED3 when a voltage of battery B is lowered, so that an operator is informed that the voltage is lowered.

When lid 12 is closed, switch SW3 is switched over to ON, a voltage is applied to lead-wire l, the voltage is then applied to resetting circuit 2, and Q outputs of MM and FF each are made to "L" and Q outputs thereof are made to "H", respectively. As shown in this example, the switch SW3 is not only allowed to be a door-switch which is made to ON by closing lid 12, but also to be an operation switch separately provided. Now, when operation starting switch SW4 is ON, an input of inverter INV1 connected to operation starting switch SW4 is changed into "L", and an input of FF1 of operation starting signal circuit 4 is changed from "L" into "H". Because the input of FF1 is applied with "H", the output Q thereof is changed from "L" into "H" so as to be applied to input terminal A of MM4 of timer circuit 5. Resistor $R_{10}$ and capacitor $C_7$ connecting respectively to terminals T1, T2 of MM4 are formed into an integral network so that the $\overline{Q}$ output is changed to keep in "L" state from "H" for a time $t_4$ determined by a time constant obtained by a product of $R_{10}$ and $C_7$ from the time when the input of "H" is applied to the input terminal, and the $\overline{Q}$ output is then changed again into "H" after passing away a time $t_4$. The $\overline{Q}$ output is connected to the input terminal of OR3 and the input thereof will be changed from "H" into "L" and vice versa. The other input terminal is connected to the $\overline{Q}$ output terminal of MM3 in timer circuit 87, and an output in "H" is given from the $\overline{Q}$ output by an initial resetting. Therefore, an output of OR3 will be in "L" only when the $\overline{Q}$ output of MM4 is in "L" and is in "H" when in the other state. The output of OR3 is connected to the input of AND3, and the other input of AND3 is connected to the output of AND4. One of the input terminals of AND4 is connected to Q output of FF1 so that the Q output is changed into "H" output to be fed into the Q output when switching operation start switch SW4 over to ON. Another input terminal is connected to the $\overline{Q}$ output of FF3 in operation completion signal circuit 84 through resistors $R_8$ and $R_7$, and it receives an input in "H" and an output of AND4 is in "H" when being applied with an initial resetting. The output of AND4 in "H" is applied to the input of AND3 and the output of AND3 will be in "H" only when the outputs of AND5 and AND4 are in "H". Therefore, the output of AND3 will be in "H" when the Q output of FF1 is in "H" and the $\overline{Q}$ output of MM4 is in "H" after time $t_4$ was passed away. Time $t_4$ from the point of time when operation start switch SW4 is ON upto the point of time when the output of AND3 is in "H" is a period of time required for that developer D is pushed out from container 101 to satisfactorily adhere to material W coated with processing chemicals. The output terminal of AND3 is connected to the respective input terminals of AND1 and AND2, another input terminal of AND1 to the $\overline{Q}$ output of FF2, and another input terminal of AND2 to the Q output of FF2 through a resistor, respectively. The output of AND1 will therefore be in "H" by changing the output of AND3 into "H", however, the output of AND2 is still in "L", because the other input of AND2 is connected to the Q output of FF2. Motor control circuit 7 (Model M54543 L, manufactured by Mitsubishi Electric Co., Japan, in this Example) is so constructed as to rotate motor M in the taking-up direction when input 4 is fed in "H" state and input 6 is fed in "L" state, and then to rotate in the rewinding direction when input 4 is fed in "L" and input 6 is fed in "H" state, and further to put it on the brakes when both inputs 4 and 6 are fed in "H" state. When the output of AND1 is in "H" and the output of AND2 is in "L", the motor M is then commenced to take up roll-film F and material W coated with processing chemicals.

The motor M will be stopped in motion when completing a taking-up of roll-film F and material W after progressing the taking-up operation.

In this example, the motor stopping mechanism is operated in such a manner that, in motor rotation detecting circuit 9, an encoder is arranged onto the rotor (e.g., a take-up spool 511) of motor M between light emission device LED1 and photoreceptor element PH1 so that the rotation of the motor M can be detected by measuring the pulse intervals of light incident to the photoreceptor PH1. Besides this method, it is also allowed to detect such a rotation by making use of, for example, a magnetic sensor. It is further allowed to detect with an excessive load detecting mechanism provided to spool 21 in a cartridge, so as to detect such a variation in film tension or in rotation of a take-up spool.

Terminals $T_1$ and $T_2$ of MM2 in take-up completion detecting circuit 10 are connected to capacitor $C_2$ and resistor $R_4$ which are formed into an integral network.

Input terminal B of MM2 is connected to output Q of FF1 and FF1 will output in "H" state when shaft 511 is rotated by motor M, therefore, MM2 will be kept in operation only when motor M is being rotated.

Input terminal A of MM2 will receive the signals of light pulses incident to photoreceptor element PH1 by the aforementioned encoder during the rotation of motor M, and will not receive any light pulse when motor M is stopped to rotate, because no pulse of light is incident to the photoreceptor PH1.

When the intervals between the pulses respectively applied to input terminal A of MM2 are shorter than a time constant determined according to the values of capacitor $C_2$ and resistor $R_4$ formed in the aforementioned integral network, output Q of MM2 will be kept in "H" state, however, when the same intervals are longer than the time constant, the output Q of MM2 will be in "L" state. When the intervals therebetween applied to the output terminal A become longer than the time constant, MM2 will judge that material W coated with processing chemicals and roll-film F were taken up, so that output Q of MM2 is made into "L" state and output $\overline{Q}$ thereof into "H" state, respectively. Output Q is connected to capacitor $C_3$ through resistor $R_5$, therefore, even when output Q of MM2 is in "L" state, an input voltage of one input terminal of AND7 connected to capacitor $C_3$ through resistor $R_6$ is in "H" state, though this input of "H" is transient. The input to the other input terminal of AND7 is in "H" from output $\overline{Q}$ of MM2, therefore, AND7 will output the pulses in "H" state only for a period of time when the one input terminal of AND7 is kept in "H" state.

When the output pulses of AND7 are applied to input CP of FF2, output Q of FF2 will be in "H" state, and output $\overline{Q}$ thereof will be in "L" state. This FF2 is a flip-flop provided for reversing the rotating direction of motor M.

FF2 will start to operate when output terminal $\overline{Q}$ thereof is changed from "H" into "L", because the output terminal $\overline{Q}$ is connected to input terminal B of MM3. Through this operation, the output $\overline{Q}$ is reversed to "L" for a certain period, according to a time constant to be determined by the values of capacitor $C_6$ and resistor $R_9$ connected respectively to terminals $T_2$ and $T_1$ of MM3. This MM3 is so provided as to adjust a time $t_3$ from the moment when motor M completed to take up material W and roll-film F to the moment when the rewind thereof is commenced. Such a period can be adjusted by changing the values of capacitor $C_6$ and resistor $R_9$ respectively connected to the $T_1$ and $T_2$.

Developing time of roll-film F is required to change in some extent in accordance with the components of developer D and developing temperature, and is changed by adjusting the above-mentioned $t_3$, mainly.

When output $\overline{Q}$ of MM3 is in "L" state, one of the inputs of OR3 connected to the output $\overline{Q}$ will be in "L" and the output of AND1 will also be in "L" state. When the output of AND1 is in "L" state, the outputs of AND3 and AND1 will be in "L" state and input terminal 4 of motor control circuit 7 will be fed by "L" so as not to turn on electricity to motor M, therefore, the rotating force of motor M will be gone. Then, after passing away a time $t_3$ determined by the values of capacitor $C_6$ and resistor $R_9$ connected respectively to $T_1$ and $T_2$ of MM3, output $\overline{Q}$ of MM3 will again output an "H".

At this time, output Q of FF2 provided for reversing a rotating direction of motor M is in "H" state, and this output in "H" state is then applied to the input of AND2 and, thereby the output of AND2 will be in "H" state. On the other hand, output $\overline{Q}$ of FF2 connected to the input of AND1 is in "L" state, therefore, the output of AND1 will be in "L" state. Accordingly input 4 of motor control circuit 7 will be in "L" state, and input 6 thereof will be in "H" state. Resultantly, motor M will start to rotate in the rewinding direction so as to rewind material W and roll-film F.

When completing the rewind thereof motor M wi11 stop to rotate and rewind completion detecting circuit 8 will detect the stop. When no pulse is fed into rewind completion detecting circuit 8, AND8 will output pulses after passing away a time $t_2$ in conformity with the theory similar to that described in the case of taking-up completion detecting circuit 10. This time $t_2$ is a time required for disengaging material W from hook 513 and then separating it from roll-film F. When producing pulses from the output of AND8 after passing away a time $t_2$, these pulses are fed into FF3 of operation completion signal circuit 84 so that the outputs Q and $\overline{Q}$ of FF3 are reversed to be in "H" and "L" states, respectively. When output Q of FF3 is in "H" state, "H" is then applied to terminal CL of motor rotating direction commanding circuit connected, through OR1, to the output Q of FF3, so that FF2 is reset to the original state and the outputs Q and $\overline{Q}$ thereof will be in "L" and "H" states, respectively, provided that "H" is fed, only for a time $t_2$ and by capacitor $C_5$, to the input of AND2 connected, through resistors $R_{20}$ and $R_{11}$, to output Q of FF2. The output of AND1 is in "H" state because it has been reset to the initial state of FF2. When the output of AND2 is kept in "H" state for a time $t_2$, inputs 4 and 6 of motor control circuit 7 are applied respectively with "H" as described before, so that motor M will be put on the brakes for a time $t_2$. This braking is operated to stop the leading end of material W to the position shown in FIG. 5. If motor M should not be put on the brakes, the whole of material W is taken up by inertia of motor M so that developer D may possibly be leaked from the bottom of chamber 23 into main housing 11. Therefore, material W is so stopped to the position shown in FIG. 5 so as to prevent such a leakage.

When output Q of FF3 is in "H" state, operation completion buzzing circuit 15 connected to output Q of FF3 is applied with "H" and it shoulds buzzer 86 to inform an operator of the completion of a development process.

Even if output $\overline{Q}$ of FF3 is reversed to be in "L" state by the output of AND8, the input of AND4 connected to resistor $R_8$ is kept in "H" state only for a time $t_6$ by the function of capacitor $C_9$ connected to output $\overline{Q}$ of FF3 through resistor $R_7$. At this time, FF2 is reset to the initial state, and when the output of AND4 is kept in "H" state for a time $t_6$, motor M will be rotated in the taking-up direction only for time $t_6$. This rotation of motor M will cause such a trouble that hook 512 fitted with roll-film F is so positioned to be hard to touch by hand because of the tension of roll-film F. Therefore, in this example, it was devised that roll-film F can readily be removed from hook 512 by rotating motor M in the taking-up direction for only a time $t_6$ and thereby moving hook 512 to a position touchable by hand.

Following the above-mentioned operation, roll-film F is completed to develop, and lid 12 is opened, and then roll-film F is taken out. Thus, the whole operational procedure can be completed.

In addition, when taking up or rewinding roll-film F or the like, light emission device LED2 in operation indicating circuit 6 is turned on and off by the pulses generated from motor rotation detecting circuit 9, so that an operator can be informed that a development is being carried out.

EFFECTS OF THE INVENTION

In an automatic processing apparatus for photosensitive material use of the invention, any manual operation thereof is unnecessary through the steps from setting an exposed photosensitive material to be processed and automatically completing processing operations after closing a lid up to giving a signal of a processing completion, so that a reliable processing can always be operated; and no processing unevenness is caused in any area of photosensitive material because of taking up the photosensitive material and a material sufficiently coated with processing chemicals superposed; and, further, a processing time and properly be changed to correspond to a circumstancial temperature, the properties of the photosensitive material and the like; so that an excellent processing can be performed.

What is claimed is:

1. An automatic processing apparatus comprising a fixing means for mounting an exposed photosensitive material and a web respectively onto the processing apparatus, a take-up spool for so taking up the exposed photosensitive material and the web so that they are placed in contact with each other therein, a housing having the fixing means, the take-up spool and a means for driving the take-up spool, a processing chemicals container, a lid capable of pivoting about a joint member connected to the housing to keep the housing lightproof when the lid is closed, means for depressing said container to interlock with the lid, a coating means being disposed between said fixing means and said take-up spool, said coating means adapted to coat the processing chemicals on the web, a switching member adapted to detect the lid being closed so as to commence the taking-up operation for the exposed photosensitive material and the web coated with the processing chemicals by closing the lid.

2. The automatic processing apparatus according to claim 1, wherein the take-up spool is provided with a fitting means for fitting thereto the leading ends of the exposed photosensitive material and the material coated with processing materials.

3. The apparatus of claim 1, further comprising means for delaying the commencement of the taking-up operation for a predetermined period.

4. The apparatus of claim 3 wherein said means is a timer circuit.

5. An automatic processing apparatus comprising a fixing means for mounting an exposed photosensitive material and a web coated with processing chemicals respectively onto the processing apparatus, a take-up spool for so taking up the exposed photosensitive material and the web so that they are placed in contact with each other, means for driving the take-up spool, a detecting means for detecting a predetermined length of the photosensitive material being around the spool, means for completing the taking-up operation responsive to the detecting means, a control means adapted to adjust a time period from the moment when the taking-up operation is completed to the moment when a rewinding operation is commenced in accordance with properties of the photosensitive material.

6. The automatic processing apparatus according to claim 5, wherein a taking-up operation can be completed when the detecting means detects the variation of the rotation of the take-up spool.

7. An automatic processing apparatus comprising a fixing means for mounting an exposed photosensitive material and a web respectively onto the processing apparatus, a take-up spool for so taking up the exposed photosensitive material and the web so that they are placed in contact with each other, means capable of effecting reversable rotation of the take-up spool, a hook fixed on the take-up spool for holding the leading end of the material in winding direction and for releasing it in rewinding direction of the take-up spool, a coating means being disposed between the fixing means and the take-up spool for coating a processing chemical onto the web, and a rewind control means for detecting the completion of the rewind operation and for stopping the motor so as to locate the web being over the coating means after separating it from the take-up spool.

8. The automatic processing apparatus according to claim 7, wherein a control means is incorporated to adjust a period of time from the moment of completing a taking-up operation to the moment of commencing a rewinding operation.

* * * * *